US009071000B2

(12) United States Patent
Hsu et al.

(10) Patent No.: US 9,071,000 B2
(45) Date of Patent: Jun. 30, 2015

(54) INPUT/OUTPUT MODULE AND MOBILE ELECTRONIC DEVICE HAVING THE SAME

(75) Inventors: Chun-Hsiang Hsu, New Taipei (TW); Ching-Feng Hsieh, Taipei (TW)

(73) Assignees: ASKEY TECHNOLOGY (JIANGSU) LTD. (CN); ASKEY COMPUTER CORP. (TW)

( * ) Notice: Subject to any disclaimer, the term of this patent is extended or adjusted under 35 U.S.C. 154(b) by 451 days.

(21) Appl. No.: 13/484,332

(22) Filed: May 31, 2012

(65) Prior Publication Data

US 2013/0244501 A1 Sep. 19, 2013

(30) Foreign Application Priority Data

Mar. 16, 2012 (TW) ..... 101109095 A

(51) Int. Cl.
*H01R 24/00* (2011.01)
*H01R 13/514* (2006.01)
*H01R 13/512* (2006.01)

(52) U.S. Cl.
CPC ..... *H01R 13/512* (2013.01)

(58) Field of Classification Search
USPC ..... 439/638, 929, 701
See application file for complete search history.

(56) References Cited

U.S. PATENT DOCUMENTS 3,631,299 A * 12/1971 Meyer et al. ..... 361/752
5,321,583 A * 6/1994 McMahon ..... 361/770
6,146,153 A * 11/2000 Koradia et al. ..... 439/76.1
6,385,038 B1 * 5/2002 Ohnishi et al. ..... 361/679.4
7,004,780 B1 * 2/2006 Wang ..... 439/353

* cited by examiner

*Primary Examiner* — Briggitte R Hammond
(74) *Attorney, Agent, or Firm* — Schmeiser, Olsen & Watts, LLP

(57) ABSTRACT

An input/output module comprises a module body, a circuit board, and an input/output port. The circuit board is coupled to the module body and has a first surface and a second surface. A second connection portion is disposed on the second surface and electrically connected to a mobile electronic device body. The input/output port is disposed on the first surface and electrically connected to the second connection portion. The input/output port has an insertion end corresponding in position to an opening of the module body and connected to an external transmission connector. Further provided is a mobile electronic device having an input/output module, wherein the input/output module is replaceable such that the mobile electronic device has a transmission interface function and is expandable in applicability.

6 Claims, 5 Drawing Sheets

INPUT/OUTPUT MODULE AND MOBILE ELECTRONIC DEVICE HAVING THE SAME

CROSS-REFERENCE TO RELATED APPLICATION

This non-provisional application claims priority under 35 U.S.C. §119(a) on Patent Application No(s). 101109095 filed in Taiwan, R.O.C. on Mar. 16, 2012, the entire contents of which are hereby incorporated by reference.

FIELD OF TECHNOLOGY

The present invention relates to input/output modules and mobile electronic devices having the same, and more particularly, to a replaceable input/output module for enabling a mobile electronic device to perform data transmission with various transmission interfaces.

BACKGROUND

The downsizing of mobile electronic products is one of the trends in consumer electronics markets nowadays. For instance, smartphones, tablet computers, and notebook computers are becoming more compact to meet the requirements for portability while giving considerations to ease of use and performance.

To this end, considerations have to be given to the size and weight of casings and internal components, such as transmission interfaces of an input/output port, and electronic components, during the design stage and the manufacturing stage of mobile electronic products.

According to the prior art, an input/output port, which is adapted for use with a mobile electronic device, equipped with a transmission interface, and intended to carry out data transmission with an external device, is directly soldered to a motherboard of the mobile electronic device, exposed from an opening formed on the casing of the mobile electronic device, and corresponding in position to an insertion end of the input/output port. There is a wide variety of widely used transmission interfaces of input/output ports, and the input/output ports are increasingly downsized to get in line with the trend toward miniaturization. Data are entered into or sent from mobile electronic devices through Mini USB or Micro USB (transmission interfaces of USB connectors), Mini HDMI (HDMI 1.4, which is an HDMI transmission interface), or MHL (Mobile High-Definition Link) transmission interfaces, for example.

The transmission interfaces of mobile electronic devices are designed and categorized according to the data intended to be transmitted, product models, and brands. However, due to the importance of striking a balance between miniaturization and performance of mobile electronic devices, the limited space available on a motherboard and in a mobile electronic device body of a mobile electronic device imposes great limitations upon the quantity and types of installable input/output ports. As a result, if an input/output port is soldered to a motherboard in a mobile electronic device according to the prior art, the mobile electronic device will be compatible with only two to three types of transmission interfaces and thus can only perform data transmission with a specific type of transmission interfaces; hence, the mobile electronic device has to be equipped with an external connector in order to carry out data transmission with an input/output port compatible with other types of transmission interfaces. As a result, the prior art hampers the enhancement of universality and ease of use of mobile electronic devices.

SUMMARY

It is an objective of the present invention to provide a replaceable input/output module installed on a mobile electronic device and intended to enable the mobile electronic device to carry out data transmission with various transmission interfaces and be expandable in applicability.

Another objective of the present invention is to provide a mobile electronic device having a replaceable input/output module, such that the mobile electronic device can carry out data transmission with various transmission interfaces and is expandable in applicability.

In order to achieve the above and other objectives, the present invention provides an input/output module adapted to be coupled to a mobile electronic device having therein a receiving chamber with a first connection portion. The input/output module comprises: a module body removably coupled to the receiving chamber and having an opening; a circuit board coupled to the module body and having a first surface and a second surface, the second surface having thereon a second connection portion, the second connection portion being adapted to be electrically connected to the first connection portion; and an input/output port disposed on the first surface, electrically connected to the second connection portion, and having an insertion end corresponding in position to the opening.

As regards the input/output module, the circuit board is fastened and coupled to the module body by ultrasonic welding or at least a screw.

As regards the input/output module, the first connection portion comprises a pogo pin, and the second connection portion comprises a conductive metal contact corresponding in position to the first connection portion.

As regards the input/output module, the first connection portion and the second connection portion are electrically connected by a board-to-board connection, a flexible printed circuit, or a flexible flat cable.

As regards the input/output module, a transmission interface of the input/output port includes USB (Universal Serial Bus), HDMI (High-Definition Multimedia Interface), IEEE 1394, and/or MHL (Mobile High-Definition Link.)

As regards the input/output module, the module body further comprises a covering element for covering the opening in part or in whole. The covering element is a flexible plate or a rigid lid.

As regards the input/output module, the module body further comprises a fastening hole for fastening the input/output module to the mobile electronic device by a fastening element.

In order to achieve the above and other objectives, the present invention further provides a mobile electronic device having an input/output module. The mobile electronic device comprises a mobile electronic device body and an input/output module. The mobile electronic device body has a receiving chamber. The receiving chamber has a first connection portion. The input/output module comprises: a module body removably coupled to the receiving chamber and having an opening; a circuit board coupled to the module body and having a first surface and a second surface, the second surface having thereon a second connection portion, the second connection portion being adapted to be electrically connected to the first connection portion; and an input/output port disposed on the first surface, electrically connected to the second connection portion, and having an insertion end corresponding in position to the opening.

As regards the mobile electronic device, the first connection portion and the second connection portion are electrically connected by a pogo pin together with a conductive metal contact, a board-to-board connection, a flexible printed circuit, or a flexible flat cable.

Accordingly, unlike the prior art which discloses an input/output port disposed at and fixed to a mobile electronic device and disadvantageously characterized in that the input/output port requires an external adapter for switching between different transmission interfaces, the present invention provides in an embodiment thereof a replaceable input/output module disposed at a mobile electronic device body, such that the input/output module is replaced as needed to allow the mobile electronic device to carry out data transmission with various transmission interfaces and thus be expandable in applicability.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION

Figure 1:
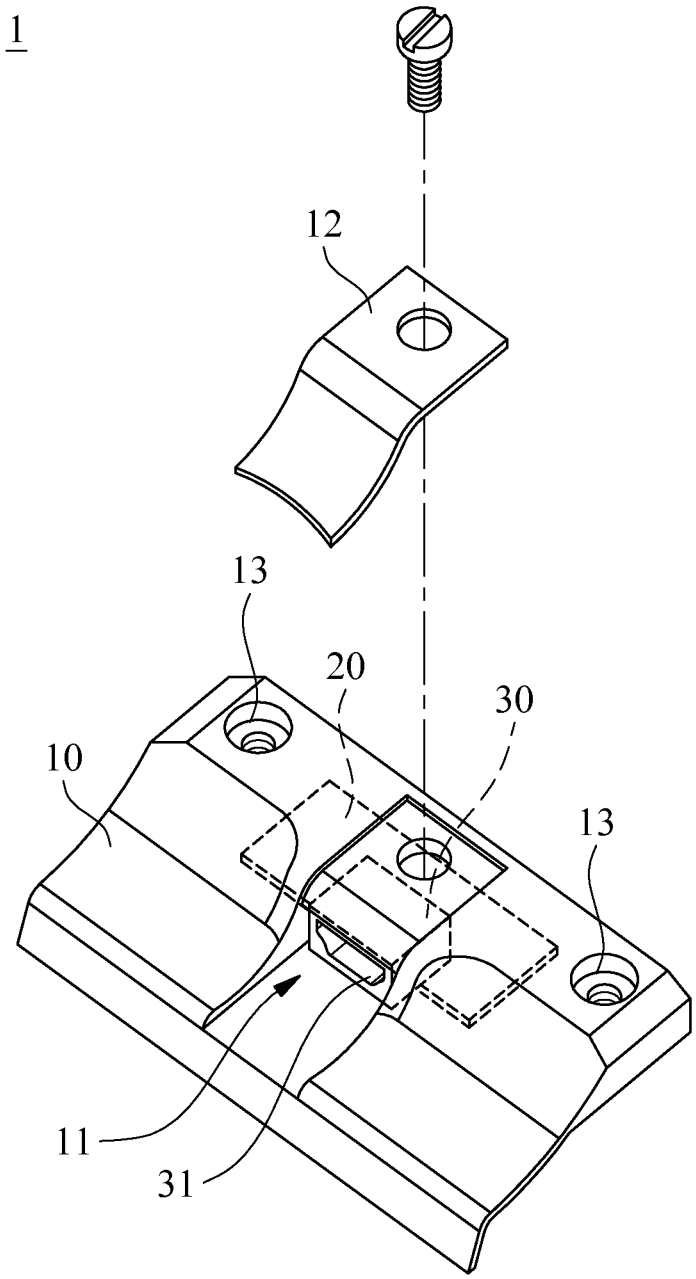
FIG. 1 is a structural schematic view of an input/output module according to an embodiment of the present invention.
Figure 2:
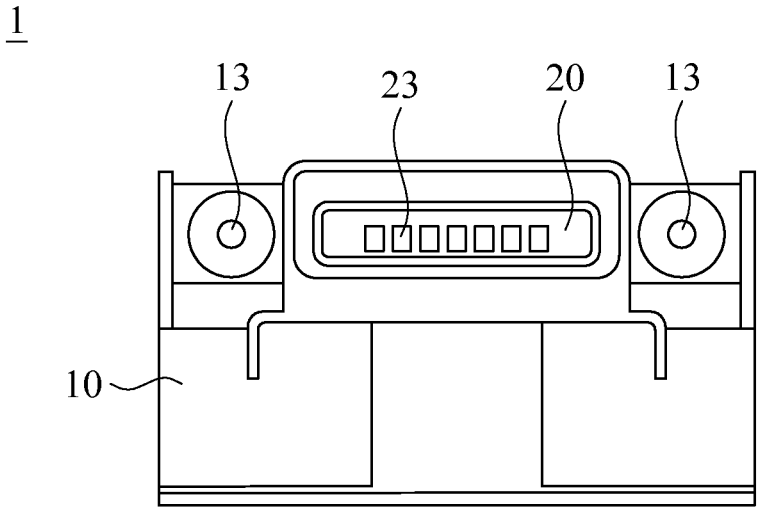
FIG. 2 is a bottom view of the input/output module according to an embodiment of the present invention.
Figure 3:
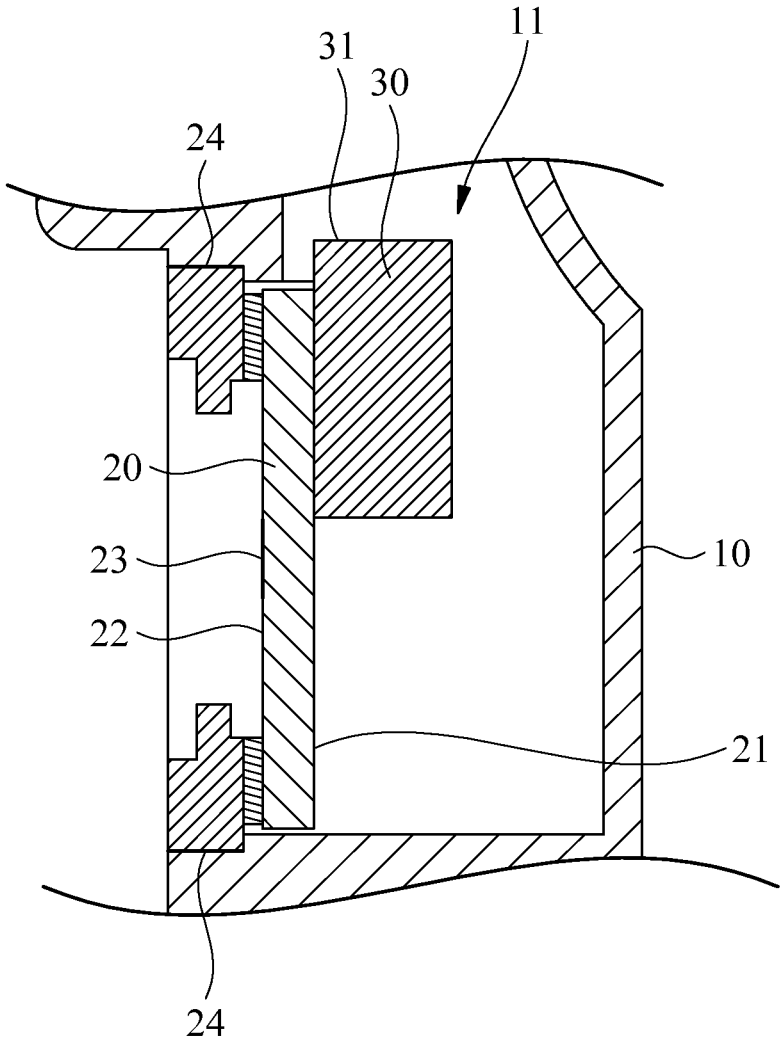
FIG. 3 is a cross-sectional schematic view of the input/output module according to an embodiment of the present invention.
Figure 4:
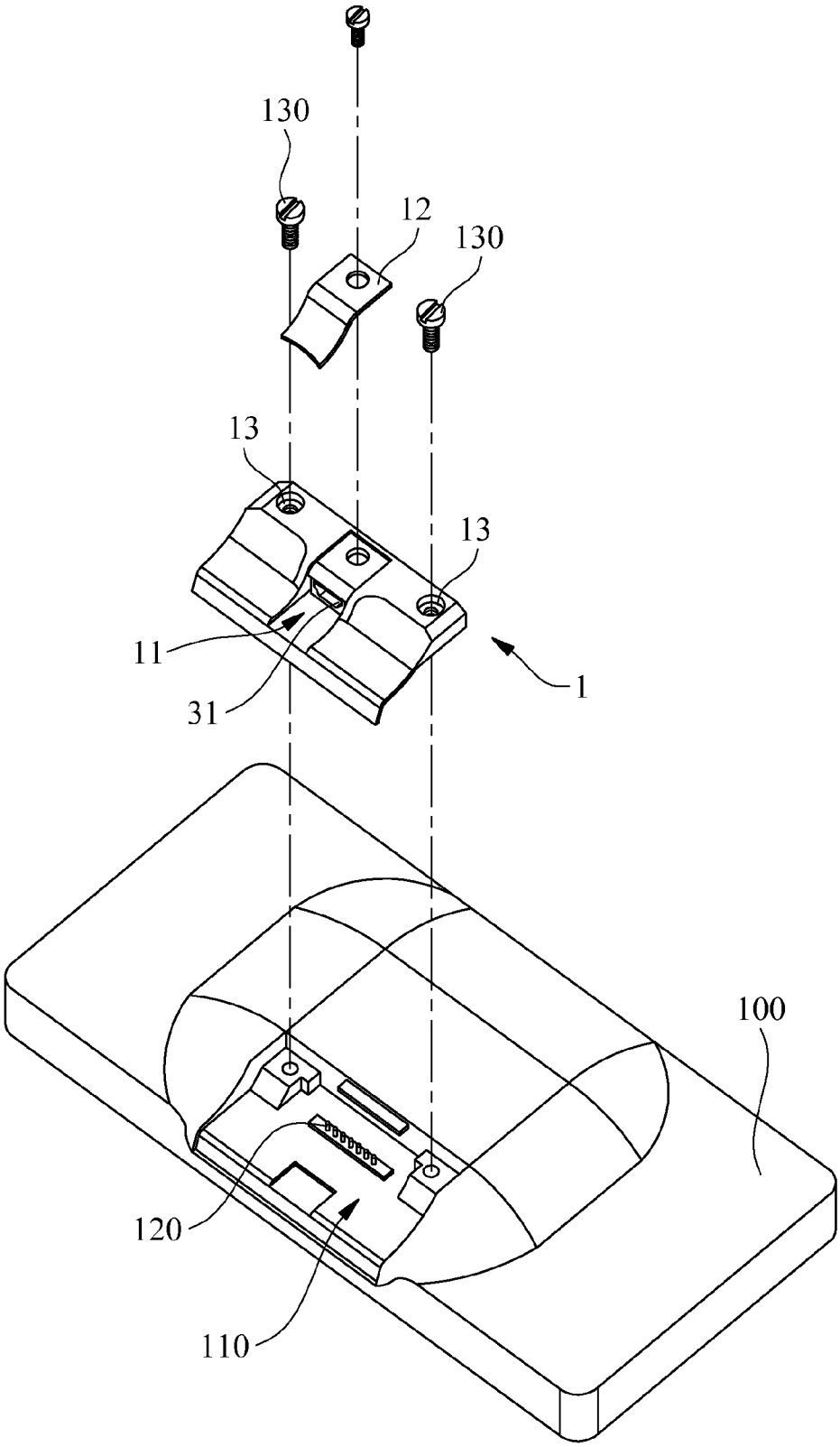
FIG. 4 is an exploded schematic view of a mobile electronic device having an input/output module according to an embodiment of the present invention.

Referring to FIG. 1 through FIG. 4, there are shown a structural schematic view of an input/output module according to an embodiment of the present invention in FIG. 1, a bottom view of the input/output module according to an embodiment of the present invention in FIG. 2, a cross-sectional schematic view of the input/output module according to an embodiment of the present invention in FIG. 3, and an exploded schematic view of a mobile electronic device having an input/output module according to an embodiment of the present invention in FIG. 4.

In an embodiment of the present invention, an input/output module 1 is removably coupled to a receiving chamber 110 of a mobile electronic device body 100. A first connection portion 120 is disposed at the receiving chamber 110. The input/output module 1 comprises a module body 10, a circuit board 20, and an input/output port 30. The module body 10 is removably coupled to the receiving chamber 110. The module body 10 comprises an opening 11 and accommodates the circuit board 20. The circuit board 20 is coupled to the module body 10 and has a first surface 21 and a second surface 22. A second connection portion 23 is disposed on the second surface 22 and electrically connected to the first connection portion 120. The input/output port 30 is disposed on the first surface 21 and electrically connected to the second connection portion 23. The input/output port 30 has an insertion end 31. The insertion end 31 corresponds in position to the opening 11.

In this embodiment, the input/output port 30 is compatible with various transmission interfaces, such as Mini USB or Micro USB (transmission interfaces of USB connectors), Mini HDMI or Micro HDMI (HDMI (High-Definition Multimedia Interface) transmission interface), or IEEE 1394, MHL (Mobile High-Definition Link) transmission interfaces, such that the input/output module 1 is compatible with various transmission interfaces. Hence, the mobile electronic device body 100 widens its selection of transmission interfaces by changing the input/output module 1 and thereby enhances product applicability. In this embodiment, the input/output port 30 is exemplified by a port compatible with a Mini USB transmission interface.

In this embodiment, the mobile electronic device is exemplified by a tablet computer, but the present invention is not limited thereto. The input/output module 1 of the present invention is applicable to various portable mobile electronic devices, such as mobile phones, tablet computers, and notebook computers. Accordingly, the input/output module 1 of the present invention expands the applicability of mobile electronic devices, enhances miniaturization of mobile electronic devices, and eliminates the limitations imposed by the prior art upon the types and quantity of installable ports.

Referring to FIG. 1, FIG. 2, and FIG. 4, in an embodiment of the present invention, the mobile electronic device body 100 comprises the receiving chamber 110, and the first connection portion 120 is disposed at the receiving chamber 110. The first connection portion 120 is electrically connected to the second connection portion 23 and thereby electrically connected between the input/output module 1 and the mobile electronic device body 100 for carrying out data transmission. The first connection portion 120 comprises a pogo pin. The second connection portion 23 comprises a conductive metal contact corresponding in position to the first connection portion 120. Hence, once the input/output module 1 is mounted on the mobile electronic device body 100, the second connection portion 23 will be in contact with and electrically connected to the first connection portion 120. The electrical connection between the second connection portion 23 of the input/output module 1 and the first connection portion 120 of the mobile electronic device body 100 is not limited to the above-mentioned, but can also be effectuated by a board-to-board means, a flexible printed circuit, or a flexible flat cable.

Referring to FIG. 3, in an embodiment of the present invention, the circuit board 20 in the input/output module 1 is coupled to the module body 10 by ultrasonic welding. As shown in the diagram, ultrasonic welding is performed on a joint portion 24 of the circuit board 20 to couple the circuit board 20 and the module body 10 together by ultrasonic welding, such that the circuit board 20 having the input/output port 30 mounted thereon is coupled to the module body 10. Ultrasonic welding is performed on two objects corresponding in shape and structure to each other such that one of the two objects is laminated and welded to the other one of the two objects. The input/output module 1 has less volume when fixed in place by ultrasonic welding than by an external fastening element. Furthermore, the way of coupling the circuit board 20 and the module body 10 together is not limited to ultrasonic welding. It is feasible that the circuit board 20 having the input/output port 30 is screwed to the module body 10 with at least a screw penetratingly disposed at two screw holes formed in the circuit board 20 and the module body 10, respectively, thereby finalizing the assembly of the input/output module 1.

Referring to FIG. 4, there is shown an exploded schematic view of a mobile electronic device having an input/output module according to an embodiment of the present invention. The mobile electronic device comprises the mobile electronic device body 100 and has the input/output module 1. In an embodiment of the present invention, the mobile electronic device body 100 has the receiving chamber 110 therein, and the first connection portion 120 is disposed at the receiving chamber 110. The module body 10 of the input/output module 1 has at least a fastening hole 13, such as a screw hole. A fastening element 130, such as a screw, can be screwed to the at least a fastening hole 13 and at least another fastening hole formed in the mobile electronic device body 100, such that the input/output module 1 and the mobile electronic device body 100 are coupled together. However, the aforesaid screw hole and screw do not limit the way of coupling the input/output module 1 and the mobile electronic device body 100 together. It is also feasible that the input/output module 1 and the mobile electronic device body 100 are coupled together by means of their respective fastening mechanisms or snap-engagement mechanisms.

Figure 5:
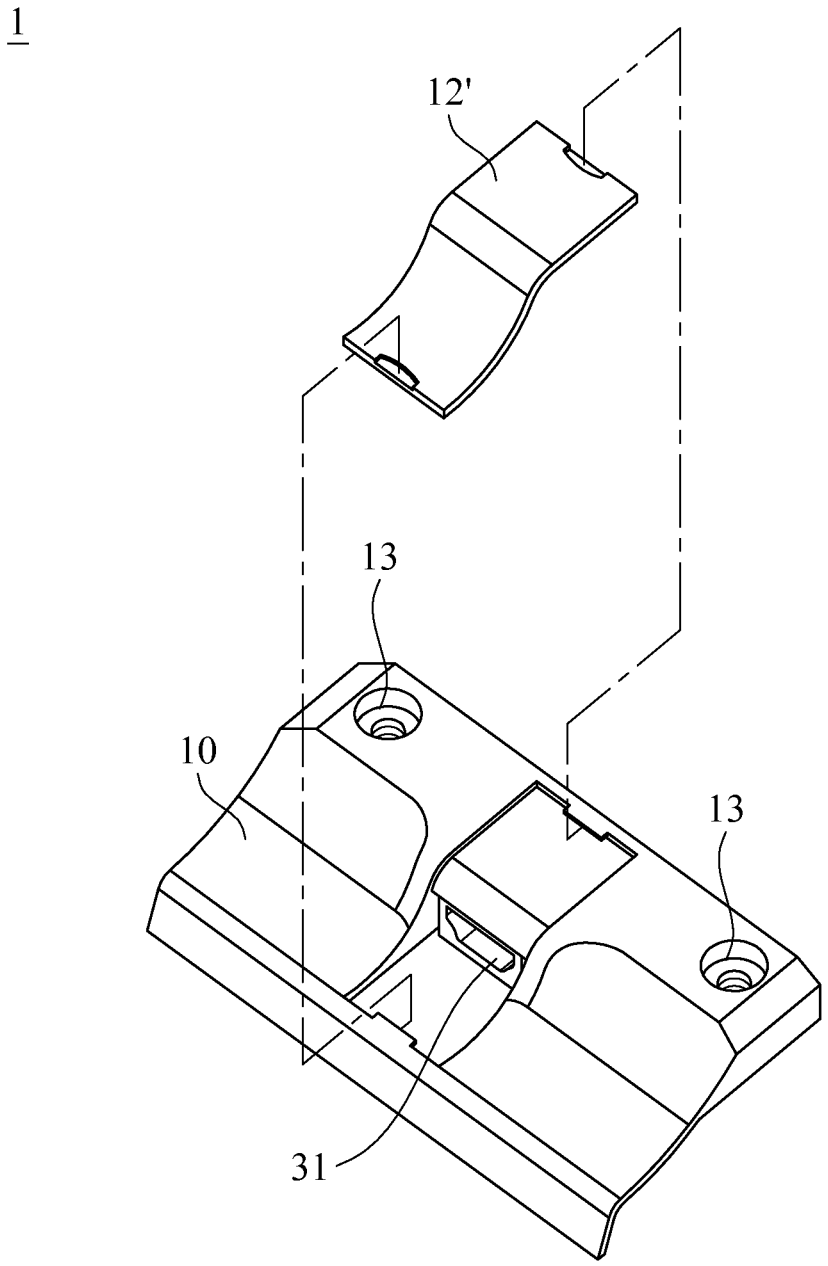
FIG. 5 is a schematic view of the input/output module comprises another covering element according to an embodiment of the present invention.

Referring to FIG. 4, in an embodiment of the present invention, the module body 10 of the input/output module 1 further comprises a covering element 12 corresponding in position to the opening 11 for covering the opening 11 in part or in whole and thereby giving protection to the insertion end 31 of the input/output port 30. The covering element 12 is a flexible plate partially fixed to the module body 10. To connect an external transmission connector to the insertion end 31, the user has to separate the covering element 12 from the opening 11 to the extent that the insertion end 31 is exposed for electrical connection with the external transmission connector. Referring to FIG. 5, embodiment of a covering element 12' is not limited to a flexible plate but includes a rigid lid structure removably coupled to the module body 10 for giving protection to the insertion end 31.

Accordingly, unlike the prior art which discloses an input/output port disposed at and fixed to a mobile electronic device and disadvantageously characterized in that the input/output port requires an external adapter for switching between different transmission interfaces, the present invention provides in an embodiment thereof a replaceable input/output module disposed at a mobile electronic device body, such that the input/output module is replaced as needed to allow the mobile electronic device to carry out data transmission with various transmission interfaces and thus be expandable in applicability.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. An input/output module, removably coupled to a receiving chamber of a mobile electronic device, the receiving chamber having a first connection portion, the input/output module comprising:

a module body removably coupled to the receiving chamber and having an opening;

a circuit board coupled to the module body and having a first surface and a second surface, the second surface having thereon a second connection portion, the second connection portion being adapted to be electrically connected to the first connection portion; and an input/output port disposed on the first surface, electrically connected to the second connection portion, and having an insertion end corresponding in position to the opening;

wherein the circuit board is fastened and coupled to the module body by one of ultrasonic welding and at least a screw;

wherein the first connection portion comprises a pogo pin, and the second connection portion comprises a conductive metal contact corresponding in position to the first connection portion;

wherein the module body further comprises a covering element for covering the opening in part or in whole.

2. The input/output module of claim 1, wherein the first connection portion and the second connection portion are electrically connected by one of a board-to-board connection, a flexible printed circuit, and a flexible flat cable.

3. The input/output module of claim 1, wherein a transmission interface of the input/output port is at least one of USB (Universal Serial Bus), HDMI (High-Definition Multimedia Interface), IEEE 1394, and MHL (Mobile High-Definition Link).

4. The input/output module of claim 1, wherein the covering element is one of a flexible plate and a rigid lid.

5. The input/output module of claim 1, wherein the module body further comprises a fastening hole for fastening the input/output module to the mobile electronic device by a fastening element.

6. A mobile electronic device having an input/output module, the mobile electronic device comprising:

a mobile electronic device body having a receiving chamber having a first connection portion; and an input/output module, comprising:

a module body removably coupled to the receiving chamber and having an opening;

a circuit board coupled to the module body and having a first surface and a second surface, the second surface having thereon a second connection portion, the second connection portion being adapted to be electrically connected to the first connection portion; and an input/output port disposed on the first surface, electrically connected to the second connection portion, and having an insertion end corresponding in position to the opening;

wherein the circuit board is fastened and coupled to the module body by one of ultrasonic welding and at least a screw;

wherein the module body comprises a covering element for covering the opening in part or in whole;

wherein the first connection portion and the second connection portion are electrically connected by one of a pogo pin together with a conductive metal contact, a board-to-board connection, a flexible printed circuit, and a flexible flat cable.

* * * * *